US005511104A

United States Patent [19]

Mueller et al.

[11] Patent Number: 5,511,104

[45] Date of Patent: Apr. 23, 1996

[54] X-RAY TUBE

[75] Inventors: Werner Mueller, Wilhermsdorf; Herbert Bittl, Nuremberg; Rudolf Friedel, Moehrendorf; Roland Schmidt; Henrik Krogmann, both of Erlangen, all of Germany

[73] Assignee: Siemens Aktiengesellschaft, Munich, Germany

[21] Appl. No.: 393,932

[22] Filed: Feb. 21, 1995

[30] Foreign Application Priority Data

Mar. 11, 1994 [DE] Germany ..... 44 08 288.6
Dec. 19, 1994 [DE] Germany ..... 44 45 259.4

[51] Int. Cl.[6] ..... H01J 35/10

[52] U.S. Cl. ..... 378/125; 378/138; 378/142

[58] Field of Search ..... 378/119, 121, 378/125, 127, 137, 138, 139, 140, 141, 142

[56] References Cited

U.S. PATENT DOCUMENTS 1,992,975 3/1935 Ulrey .
2,186,380 1/1940 Hirsch .
3,549,931 12/1970 DeLucia .
4,309,637 1/1982 Fetter ..... 378/140
5,128,977 7/1992 Danos ..... 378/121
5,136,625 8/1992 Heiting et al. ..... 378/139

FOREIGN PATENT DOCUMENTS 0369529 5/1990 European Pat. Off. .
366550 1/1923 Germany .
619748 10/1935 Germany .

*Primary Examiner*—David P. Porta
*Assistant Examiner*—Don Wong
*Attorney, Agent, or Firm*—Hill, Steadman & Simpson

[57] ABSTRACT

An x-ray tube, in addition to an anode and a cathode arrangement, has first and second electrodes that are located in an evacuated housing provided with a beam exit window. The anode and the first electrode are at potentials that are positive in comparison to the potentials of the cathode arrangement and the second electrode. Further, the first and the second electrode are arranged lying opposite one another such that secondary electrons emanating from the anode must pass through the space located between the first and the second electrode in order to proceed to the beam exit window. These secondary electrons are thus substantially all prevented from reaching the beam exit window, thereby avoiding excessive heating of the beam exit window.

15 Claims, 2 Drawing Sheets

X-RAY TUBE

BACKGROUND OF THE INVENTION

1. Field of the Invention

The present invention is directed to an x-ray tube of the type having an anode and a cathode assembly that are situated in an evacuated housing provided with a beam exit window, with the anode at a common, first potential and the cathode assembly at a second potential that is negative in comparison to the first potential.

2. Description of the Prior Art

In x-ray tubes of the above type, there is a risk that secondary electrons emitted from the anode will be incident on the beam exit window and will excessively heat the beam exit window.

In order to prevent this, the space situated between anode and cathode in an x-ray tube disclosed by U.S. Pat. No. 3,549,931 is surrounded by a shield provided with a beam passage opening. This solution, however, involves substantial structural outlay.

In an x-ray tube disclosed in European Application 0 369 529, a bead is applied to the cathode, which is intended to prevent secondary electrons from proceeding to the beam exit window. The effect of this bead is, however, only slight.

In an x-ray tube disclosed in German PS 619 748, the glow cathode is arranged in the immediate proximity of the inner side of the beam exit window and the correspondingly fashioned anode is arranged in the immediate proximity of the cathode and beam exit window in order to assure that substantially all electrons emanating from the cathode are incident on the active surface of the anode. Such a structure is unsuitable for modern x-ray tubes because of the high voltages employed; the proximity of the above components does not afford sufficient dielectric strength to prevent arcing.

SUMMARY OF THE INVENTION

An object of the present invention is to provide an x-ray tube of the type initially described wherein the risk that secondary electrons will be incident on the beam exit window is effectively reduced with little structural outlay.

This object is achieved in accordance with the principles of the present invention in an x-ray tube which, in addition to having an anode and a cathode arrangement, has first and second electrodes that are located in an evacuated housing provided with a beam exit window, the anode and the first electrode being at potentials that are positive in comparison to the potentials of the cathode arrangement and the second electrode lie, and whereby the first and the second electrode are arranged lying opposite one another such that secondary electrons emanating from the anode must pass through the space located between the first and the second electrodes in order to proceed to the beam exit window of the housing. The first and the second electrodes thus form, in effect, a capacitor, and secondary electrons emanating from the anode would have to proceed through the space located between the plates thereof in order to proceed to the beam exit window. Secondary electrons entering the space between the electrodes, however, are deflected in the direction toward the first electrode, so that the majority of the secondary electrons again strike the anode, or strike either the first electrode or the housing. If at all, only very few secondary electrons thus reach the beam exit window. The risk of an excessive heating of the beam exit window is avoided as a consequence of the inventive fashioning of the x-ray tube.

Although x-ray tubes disclosed in German PS 366 550 as well as U.S. Pat. Nos. 2,186,380, and 1,992,975 and in Japanese Application 52-85492 (Abstract) have one or two additional electrodes, a beam exit window is not present, so that the problem to be solved does not occur in these x-ray tubes.

It is especially effective when the anode and the first electrode lie at a common, first potential and the cathode arrangement and the second electrode lie at a common, second potential that is negative in comparison to the first potential.

Preferably, the second electrode and the cathode arrangement are placed at the aforementioned common, second potential by being electrically connected to each other. Also preferably, when the housing lies at the first potential in common with the anode and the first electrode, the first electrode is attached to the housing via an electrically conductive connection. It is thus assured in a simple way that each of the first and second electrodes is at a suitable potential.

In one version of the invention at least the first or the second electrode is plate-shaped. A plate-shape assures that all secondary electrons propagating in the direction toward the beam exit window are deflected by the electrical field located between the electrodes.

For that case wherein the anode of the x-ray tube has a target surface which is substantially planar, in a further embodiment of the invention at least the surface of the first electrode facing toward second electrode or the surface of the second electrode facing toward the first electrode, is also substantially planarly and proceeds parallel to the target of the anode. For that case wherein the anode of the x-ray tube is a rotating anode, in a further embodiment of the invention at least the surface of the first electrode facing toward the second electrode, or the surface of the second electrode facing toward the first electrode, proceeds substantially parallel to the target surface of the rotating anode. This means that the electrode surface respectively facing the target surface of the rotating anode is oriented parallel to the target surface and is also oriented at a right angle relative to the plane that contains the rotational axis of the rotating anode and relative to the central ray of the x-ray beam that passes through the beam exit window during operation of the x-ray tube, and the intersection line of this electrode surface with this plane proceeds substantially parallel to the intersection line of the target surface of the rotating anode with that plane. A beneficial curve of the electrical field between the two electrodes is achieved with this measure.

In a further version of the invention the space located between the surfaces of the electrodes facing toward one another is dimensioned such that the x-ray beam emanating from the focal spot of the x-ray tube and passing through the beam exit window proceeds in toto between the space located between the surfaces of the electrodes facing one another. When the electrodes are correspondingly dimensioned, it is assured that only very few secondary electrons reach the beam exit window.

In another embodiment of the invention the main propagation direction of the x-rays emanating from the focal spot of the x-ray tube and passing through the beam exit window proceeds approximately parallel to at least one of the surfaces of the electrodes facing one another. This arrangement assures that the electric strength of the x-ray tube is not or is only slightly, lessened by the presence of the electrodes.

An even smaller decrease of the electric strength of the x-ray tube is achieved when the smallest spacing between the electrodes, or the smallest spacing of the second electrode from the housing, is not substantially less than the smallest spacing between the anode and the cathode arrangement.

DESCRIPTION OF THE PREFERRED EMBODIMENTS

Figure 1:
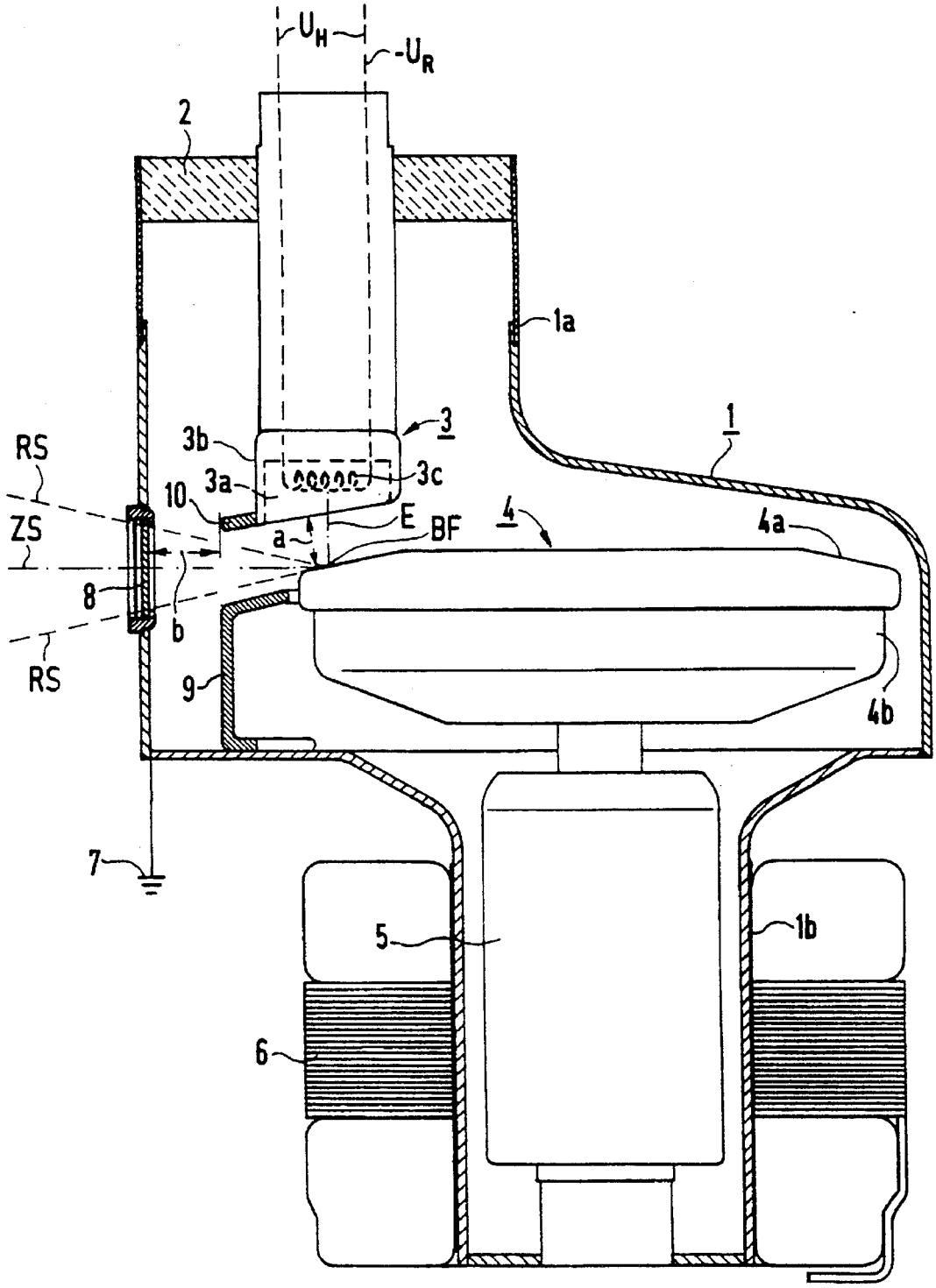
FIG. 1 shows an x-ray tube of the invention in a longitudinal section.
Figure 2:
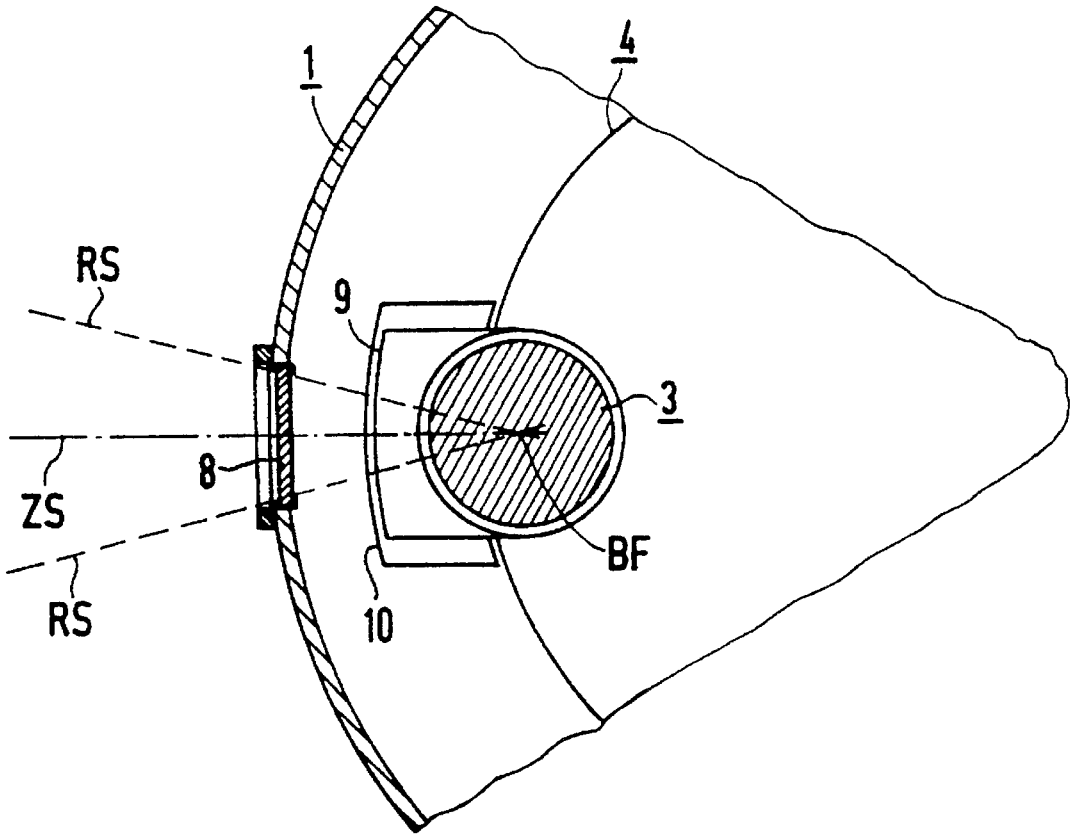
FIG. 2 shows a partial cross section through the x-ray tube of FIG. 1.

The x-ray tube shown in FIGS. 1 and 2 has a vacuum housing 1 fabricated of metal and having a tubular shoulder 1*a*. A schematically indicated cathode assembly generally referenced 3 which forms an electron source is introduced into the housing 1 through 2. An electron beam E indicated with broken lines in FIG. 1 proceeds therefrom, this electron beam E being incident on the target surface 4*a* of a rotating anode generally referenced 4 in a focal spot BF. In the case of the described exemplary embodiment, the cathode assembly-as schematically indicated in FIG. 1 contains a glow cathode 3*c* received in a focusing groove 3*a* of a cathode cup 3*b*.

In a known way that is not shown in greater detail, the rotating anode 4 is rotatably seated on a second shoulder 1*b* of the vacuum housing 1.

The rotating anode 4 has a rotor 5 connected to the anode body 4b that interacts with a stator 6 attached at the outside on the shoulder 1*b* in the manner of a squirrel-cage motor.

The rotating anode 4 and the vacuum housing 1 are electrically connected to one another. In the case of the illustrated exemplary embodiment, they lie at ground potential 7. One terminal of the glow cathode 3*c* is at negative high-voltage $-U_R$, for example at 125 kV. The filament voltage $U_H$ is across the two terminals of the glow cathode 3*c*.

The vacuum housing 1 is provided with a beam exit window 8 formed, for example, of a metal like beryllium or any other suitable material of low transparency to x-rays through which the x-ray beam emanating from the focal spot BF emerges during operation of the x-ray tube, the central ray ZS and the margin rays RS of the x-ray beam being indicated with broken lines in FIGS. 1 and 2.

In addition to the cathode 3 and the rotating anode 4, a first electrode 9 that lies at the first potential, namely ground potential 7, in common with the vacuum housing 1 and the rotating anode 4 is arranged inside the vacuum housing 1.

A second additional electrode 10 that lies at the second potential, i.e. at the negative high-voltage $-U_R$, in common with the cathode 3 is attached to the cathode 3. The two electrodes 9 and 10 are arranged opposite one another such that secondary electrons emanating from the incident surface 4*a* of the rotating anode 4 during operation of the x-ray tube must pass though the space located between the electrodes 9 and 10 in order to proceed to the beam exit window 8. Since, however, the electrodes 9 and 10 effectively form a capacitor, secondary electrons entering into the space located between the electrodes 9 and 10 are deflected in the direction toward the first electrode 9, so that they either again strike the rotating anode 4, or strike either the first electrode 9 or the vacuum housing 1. Extremely few, if any, secondary electrons reach the beam exit window 8, so that excessive heating of the beam exit window 8 is avoided. In the case of the described exemplary embodiment, the first electrode 9 is attached to the vacuum housing 1 with an electrically conductive connection. In the case of an x-ray tube having a stationary anode, however, there is also the possibility of attaching the second electrode to the anode.

As can be seen from FIG. 2, both the first and second electrodes 9 and 10 are plate-shaped in order to assure that essentially all secondary electrons propagating in the direction toward the beam exit window 8 are deflected by the electrical field located between the electrodes 9 and 10. As can be seen from FIG. 2, the space located between the surfaces of the electrodes 9 and 10 facing toward one another is dimensioned such in detail that the useful x-ray beam emanating from the focal spot BF and passing through the x-ray window 8 passes into toto through the space situated between the surfaces of the electrodes 9 and 10 facing toward one another. The main propagation direction—illustrated by the central ray ZS—of the x-ray beam emanating from the focal spot BF proceeds essentially parallel to the surfaces of the electrodes 9 and 10 facing one another. The distance a between the surfaces of the electrodes 9 and 10 facing one another and the distance b between the electrode 10 and the vacuum housing 1 or the beam exit window 8, is slightly larger than the smallest spacing between the cathode 3 and the rotating anode 4. In order to assure a beneficial path of the electrical field located between the electrodes 9 and 10, those surfaces of the electrodes 9 and 10 facing one another are essentially planar, i.e. are slightly conically curved in such a way that they proceed substantially parallel to the target surface 4*a* of the rotating anode 4 that is slightly frustrum-shaped and, therefore, likewise substantially planar.

Although it is especially advantageous when, as in the case of the described exemplary embodiment, the anode, the first electrode and possibly the vacuum housing 1 lie at a common, first potential and the cathode arrangement and the second electrode lie at a common, second potential that is negative in comparison to the first potential, neither the anode and the first electrode (and possibly the vacuum housing 1) need necessarily be at the same potential nor need the cathode arrangement and the second electrode be at the same potential.

The above-described x-ray tube is a single-pole x-ray tube wherein the vacuum housing 1 and the anode 4 lie at a common potential. The invention, however, can also be employed in two-pole x-ray tubes wherein the vacuum housing lies at a potential that is between that of the anode and that of the cathode.

Although modifications and changes may be suggested by those skilled in the art, it is the intention of the inventors to embody within the patent warranted hereon all changes and modifications as reasonably and properly come within the scope of their contribution to the art.

We claim as our invention:

1. An x-ray tube comprising:

an evacuated housing having a beam exit window;

a cathode assembly and an anode disposed in said housing;

means for placing said anode and said cathode assembly at respective electrical potentials with the electrical potential of said anode being positive in comparison to the electrical potential of said cathode assembly for causing said anode to emit x-rays, and said anode also emitting secondary electrons, said anode being oriented so that said x-rays exit said housing through said beam exit window; and first and second electrodes disposed opposite each other in said housing and means for placing said first and second electrodes at respective electrical potentials with the electrical potential of said first electrode being positive in comparison to the electrical potential of said cathode assembly and the electrical potential of said second electrode, said first and second electrodes being oriented in said housing so that secondary electrons emanating from said anode must pass between said first and second electrodes before reaching said beam exit window, and said first and second electrodes and said means for placing said first and second electrodes at respective electrical potentials comprising, in combination, means for preventing substantially any of said secondary electrons from reaching said beam exit window.

2. An x-ray tube as claimed in claim I wherein said means for placing said anode at an electrical potential and said means for placing said first electrode at an electrical potential comprise, in combination, means for placing said anode and said first electrode at a common, first potential, and wherein said means for placing said cathode assembly at an electrical potential and said means for placing said second electrode at an electrical potential comprise, in combination, means for placing said cathode assembly and said second electrode at a common, second potential which is negative in comparison to said first potential.

3. An x-ray tube as claimed in claim 2 further comprising means for placing said housing at said first potential in common with said anode and said first electrode.

4. An x-ray tube as claimed in claim 3 wherein said means for placing said housing at said first potential comprises a direct an electrical connection between said housing and said first electrode.

5. An x-ray tube as claimed in claim 2 wherein said means for placing said cathode assembly and said second electrode at said common, second potential comprises a direct electrically conductive connection between said second electrode and said cathode assembly.

6. An x-ray tube as claimed in claim 1 wherein at least one of said first and second electrodes comprises a plate-shaped electrode.

7. An x-ray tube as claimed in claim 6 wherein said anode has a substantially planar target surface and wherein said first electrode has a substantially planar surface facing said second electrode, said surface of said first electrode facing said second electrode being parallel to said target surface of said anode.

8. An x-ray tube as claimed in claim 6 wherein said anode has a substantially planar target surface, and wherein said second electrode has a substantially planar surface facing said first electrode, said substantially planar surface of said second electrode being parallel to said target surface of said anode.

9. An x-ray tube as claimed in claim 6 wherein said anode comprises a rotating anode having a target surface, and wherein said first electrode has a surface facing said second electrode disposed substantially parallel to said target surface of said rotating anode.

10. An x-ray tube as claimed in claim 6 wherein said anode comprises a rotating anode having a target surface, and wherein said second electrode has a surface facing said first electrode disposed substantially parallel to said target surface of said rotating anode.

11. An x-ray tube as claimed in claim 6 wherein said first and second electrodes have respective surfaces facing each other and said surfaces being spaced from each other so that said x-ray beam emanating from said anode and passing through said beam exit window proceeds completely between said surfaces of said electrodes.

12. An x-ray tube as claimed in claim 6 wherein said x-ray beam emanating from said anode has a central ray, and wherein said first and second electrodes have respective surfaces facing each other with at least one of said surfaces being disposed substantially parallel to said central ray.

13. An x-ray tube as claimed in claim 1 wherein said anode and said cathode assembly have a spacing therebetween including a smallest spacing, and wherein said first and second electrodes are spaced from each other by a distance which is not substantially less than said smallest spacing.

14. An x-ray tube as claimed in claim 1 wherein said anode and said cathode assembly have a spacing from each other which includes a smallest spacing, and wherein said second electrode is spaced from said housing by a distance which is not substantially less than said smallest spacing.

15. An x-ray tube comprising:

an evacuated housing having a beam exit window;

a cathode assembly and an anode disposed in said housing;

means for placing said anode and said cathode assembly at respective electrical potentials with the electrical potential of said anode being positive in comparison to the electrical potential of said cathode assembly for allowing said anode to emit x-rays during operation of said x-ray tube, said anode being oriented so that said x-rays exit said housing trough said beam exit window, and secondary electrons emanating from said anode during operation of said x-ray tube; and first and second electrodes disposed opposite each other in said housing and means for placing said first and second electrodes at respective electrical potentials with the electrical potential of said first electrode being positive in comparison to the electrical potential of said cathode assembly and the electrical potential of said second electrode and with the electrical potential of said second electrode being negative in comparison to the electrical potential of said anode, said first and second electrodes being oriented opposite each other in said housing so that secondary electrons emanating from said anode must pass between said first and second electrodes before reaching said beam exit window, and said first and second electrodes and said means for placing said first and second electrodes at respective electrical potentials, in combination, preventing substantially any of said secondary electrons from reaching said beam exit window.

* * * * *